United States Patent [19]

Aizawa

[11] 4,349,900

[45] Sep. 14, 1982

[54] ELECTRONIC TIMEPIECE WITH ERROR COMPENSATION CIRCUIT

[75] Inventor: Hitomi Aizawa, Suwa, Japan

[73] Assignee: Kabushiki Kaisha Suwa Seikosha, Chuo, Japan

[21] Appl. No.: 124,892

[22] Filed: Feb. 26, 1980

[30] Foreign Application Priority Data

Feb. 26, 1979 [JP] Japan ..... 54/21639

[51] Int. Cl.[3] ..... G04C 9/00; G04B 29/00; H01H 9/00

[52] U.S. Cl. ..... 368/187; 368/321; 200/4

[58] Field of Search ..... 368/69, 70, 187–189, 368/190, 319–321; 200/4, 6 R

[56] References Cited

U.S. PATENT DOCUMENTS

| | | | |
|---|---|---|---|
| 3,841,081 | 10/1974 | Komaki | 368/320 |
| 3,871,168 | 3/1975 | Maire et al. | 368/188 |
| 3,975,897 | 8/1976 | Naito | 368/187 |
| 4,034,551 | 7/1977 | Ushiyama | 368/189 |
| 4,095,405 | 6/1978 | Tanaka | 368/321 |
| 4,135,359 | 1/1979 | Yajima | 368/69 |
| 4,188,776 | 2/1980 | Scherrer | 368/70 |
| 4,245,338 | 1/1981 | Sekiya et al. | 368/187 |

*Primary Examiner*—Vit W. Miska

*Attorney, Agent, or Firm*—Blum, Kaplan, Friedman, Silberman and Beran

[57] ABSTRACT

An electronic timepiece including an external member which by linear and rotating motion actuates three switch functions, comprises circuits to correct for inadvertent improper sequencing in actuation of the external member. A counter-timer discriminates between inadvertent actuations occurring at abnormally short time intervals and normal actuations at longer intervals, and in cooperation with memory circuits, restores conditions which have been inadvertently altered.

11 Claims, 5 Drawing Figures

ELECTRONIC TIMEPIECE WITH ERROR COMPENSATION CIRCUIT

BACKGROUND OF THE INVENTION

This invention relates generally to an electronic timepiece which can operate in a plurality of modes, and more particularly to an electronic timepiece wherein the plurality of modes are controlled by operation of an external member. In prior art electronic timepieces, push-buttons have been used for providing various correction and setting inputs. When the time setting of a conventional analog timepiece with mechanical hands is corrected, the hands move with the motion of the external stem so that the user can sense a cooperation between the stem which he rotates and the hands on the face of the dial. As a result, watch owners who are accustomed to correcting the time for an analog watch are unfamiliar and uncomfortable with the push-button mode of correction and adjustment provided in the electronic timepieces. As a result, electronic timepieces have been designed using external stem members which operate similarly to the external stems of conventional mechanical timepieces. More particularly, the stem may be pulled out, pushed in, and rotated in either direction. The external member has been used for many purposes including change in the functional mode which is displayed by the timepiece and for correction of the displayed modes. The multi-function timepieces require that the external member be used to perform many functions by combinations of sequential operations of the member. This avoids the need for a large plurality of external members.

However, the requirement to perform specific sequences of operations of the external member, for example, pulling the member and then rotating the member, leads to difficulties primarily because the user frequently provides erroneous imputs to the circuits by inadvertent operation of the stem member in an improper sequence. For example, when intending to pull out the stem member and then rotate, the user frequently begins rotation simultaneously with the pulling. In such a case, the rotational switch may be actuated before the pull-switch is actuated and the wrong result is achieved whether in setting or adjusting a mode or changing a mode of display.

What is needed is an electronic timepiece operated by an external stem member controlling a plurality of functions, and automatically compensating for inadvertent mis-sequencing of the external member actuations.

SUMMARY OF THE INVENTION

Generally speaking in accordance with the invention, an electronic timepiece having an external member for controlling a plurality of functional modes, and capable of compensating for inadvertent corrections of modes is provided. The electronic timepiece includes an external member or stem which by linear and rotary motion actuates three switch functions and further comprises circuits to correct for inadvertent and improper sequencing in actuation of the external member. A counter-timer discriminates between inadvertent actuations occurring at abnormally short time intervals and normal actuations occurring at longer intervals. In cooperation with memory circuits, conditions which have been inadvertently altered are restored to their original state. Each time, the stem is rotated, memory circuits store code data of the functional mode displayed by the timepiece at the moment the external member is actuated. When an actuation of the pull-switch associated with the external member occurs very shortly thereafter, indicating that the rotational actuation was inadvertent, the stored code data is used to return the timepiece display to its original condition.

Inadvertent corrections are also automatically reversed.

Accordingly, it is an object of this invention to provide an improved electronic timepiece having an external member incorporating a plurality of switch functions.

Another object of this invention is to provide an improved electronic timepiece wherein the displayed mode is changed by rotation of an external member in one direction, and a preferred mode is always displayed when the external member is rotated in the opposite direction.

A further object of this invention is to provide an improved electronic timepiece wherein a displayed functional mode is corrected by a linear actuation of an external member followed by a rotation of the external member.

Still another object of this invention is to provide an electronic timepiece which automatically compensates for erroneous inadvertent sequencing of operations of an external member.

Still other objects and advantages of the invention will in part be obvious and will in part be apparent from the specification.

The invention accordingly comprises the features of construction, combination of elements, arrangement of parts which will be exemplified in the construction hereinafter set forth, and the scope of the invention will be indicated in the claims.

BRIEF DESCRIPTIONS OF THE DRAWINGS

For a fuller understanding of the invention, reference is had to the following description taken in connection with the accompanying drawings, in which:

FIG. 1*a* is a plan view of a switch structure actuated by rotational and linear motions;

FIG. 1*b* is a view taken along the line b—b of FIG. 1*a;*

DESCRIPTION OF THE PREFERRED EMBODIMENTS

Figure 1A:
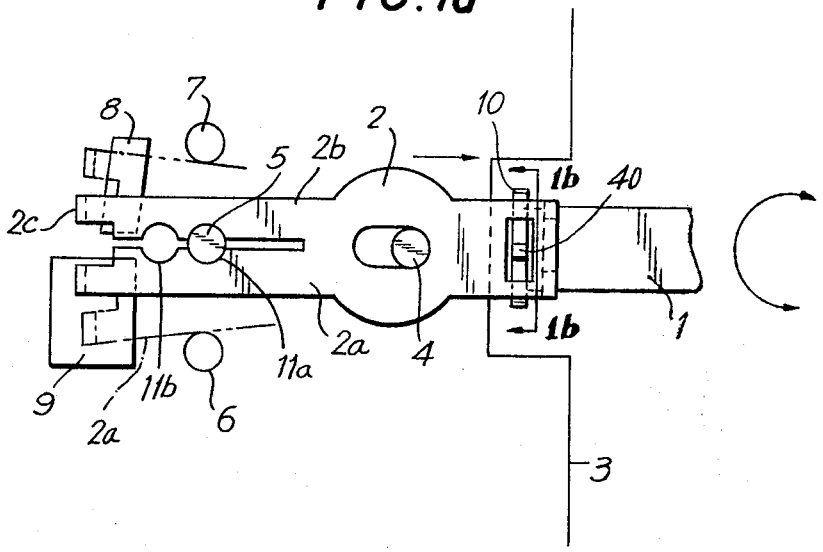
Figure 1B:
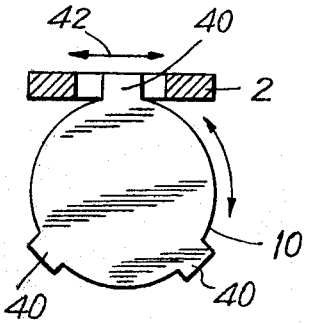
Figure 2:
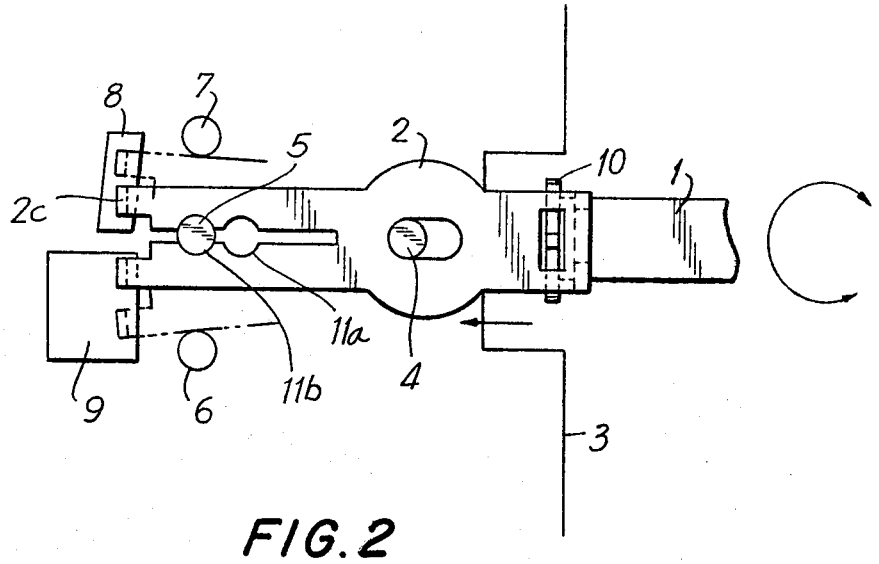
FIG. 2 is a plan view of the switch structure of FIG. 1*a* showing a pulled-out condition.

This invention relates to a electronic timepiece, and to circuitry for compensation for erroneous imputs by means of an external member. The drawing of FIG. 1*a* shows a switch structure operated by rotation in either direction and the pulling and pushing of an external control member or stem 1. When the stem is rotated to the right, that is, in a clockwise direction (FIG. 1*b*), a switch lever 2 is acted upon by a cam 10 which is integrally connected to and rotates with stem 1. Cam surfaces 40 act on the switch lever 2 to cause pivoting of the lever 2 about a pin 4 in the directions indicated by an arrow 42. When the stem 1 is rotated in the clockwise direction, a spring portion 2*a* of the switch lever 2 comes in contact (broken line) with a switch pin 6. At this time, a spring portion 2*a* of the switch lever 2 is in contact with a copper foil pattern 9 on a circuit board 3, and the spring portion 2*a* of the switch lever 2 is connected to a positive terminal of a power source (not shown). On the other hand, when the stem 1 is rotated to the left, that is, counter-clockwise (FIG. 1*b*), the spring portion 2*b* of the switch lever 2 comes in contact with a switch pin 7. Since the switch lever 2 is connected to the positive terminal of a power source as mentioned above, the switch pin 7 becomes connected with the positive terminal of the power source. When the stem 1 is pulled out (FIG. 2), the switch lever 2 is shifted from a position where a click portion 11*a* engages a pin 5 to a position where a click portion 11*b* engages with the pin 5. At this time, a leading end 2*c* of the spring portion 2*b* of the switch lever 2 comes in contact with a copper foil 8 on the circuit board 3 so that the switch is turned ON. Thus, many contacts may be opened and closed by rotation and pulling and pushing of a switch as shown in FIGS. 1 and 2. It should be understood in rotating the stem 1 that the cam surfaces 40 on the cam member 10 make intermittent contact with the switch lever 2 such that, because of the resilient qualities of the members 2*a, b,* the switch lever 2 reverts to a neutral position between each engagement of the cam profiles 40. Thus, a series of closings and openings of the switch contacts occurs.

The use of such a switch structure has some disadvantages. An explanation of these disadvantages follows, taking as an example a timepiece which has four mode functions, namely, a timekeeping function, a calendar function, an alarm function, and a timer function. Also, the correction or setting of each function is made by advancing or putting back the indication of that function. When the stem 1 and associated cam member 10 are rotated to the right, that is, clockwise, in a condition where the stem 1 remains pushed in, as shown in FIG. 1*a,* the time mode is changed to the calendar mode. The calendar mode is changed to the alarm mode and the alarm mode is changed to the timer mode by rotating the stem further in the clockwise direction. In any indicated mode, the indicated mode is changed back to the time mode by rotating the stem 1 to the left, that is, in a counter-clockwise direction (FIG. 1*b*). When the stem 1 is pulled out (FIG. 2), the indicated mode can be corrected. For example, if the calendar mode is displayed as a digit, rotation of the stem 1 to the right (clockwise) causes the calendar indication to go to a higher digit, and rotation of the stem of the left (counter-clockwise) causes the indication to go back to a lower digit.

However, when the stem 1 is pulled out in order to correct, for example, an indication in the calendar mode, there can be instances where the stem is inadvertently pulled out over its rotation. That is, there is simultaneous pulling and rotation such that portion 2*a* comes in contact with the switch pin 6 before the portion 2*c* is in contact with the copper foil 8. In particular, a rotational switch closing has occurred before a pull switch closing has occurred. This is a reversal of the desired sequence of switch closings. Thereby, though the stem is pulled out with the purpose of correcting the calendar indication, the actual effect is a correction of the alarm indication. This occurs because the calendar mode is changed to the alarm mode by the rotation of the stem in a clockwise direction as described above. On the other hand, when the stem is pushed in after the intended completion of a correction of the calendar indication, the corrected indication goes to a higher digit or backs off to a lower digit if an inadvertent rotation of the stem 1 occurs before the stem is pushed in to open the pull-push switch.

In summarizing, when the stem 1 is not pulled out in a straight manner, that is, there is unintended rotation combined with the linear motion, an undesired switch may be opened or closed. Such operation of a timepiece is not most desirable for the user. The timepiece in accordance with this invention eliminates the undesired results of inadvertent operations of the stem member.

Figure 3:
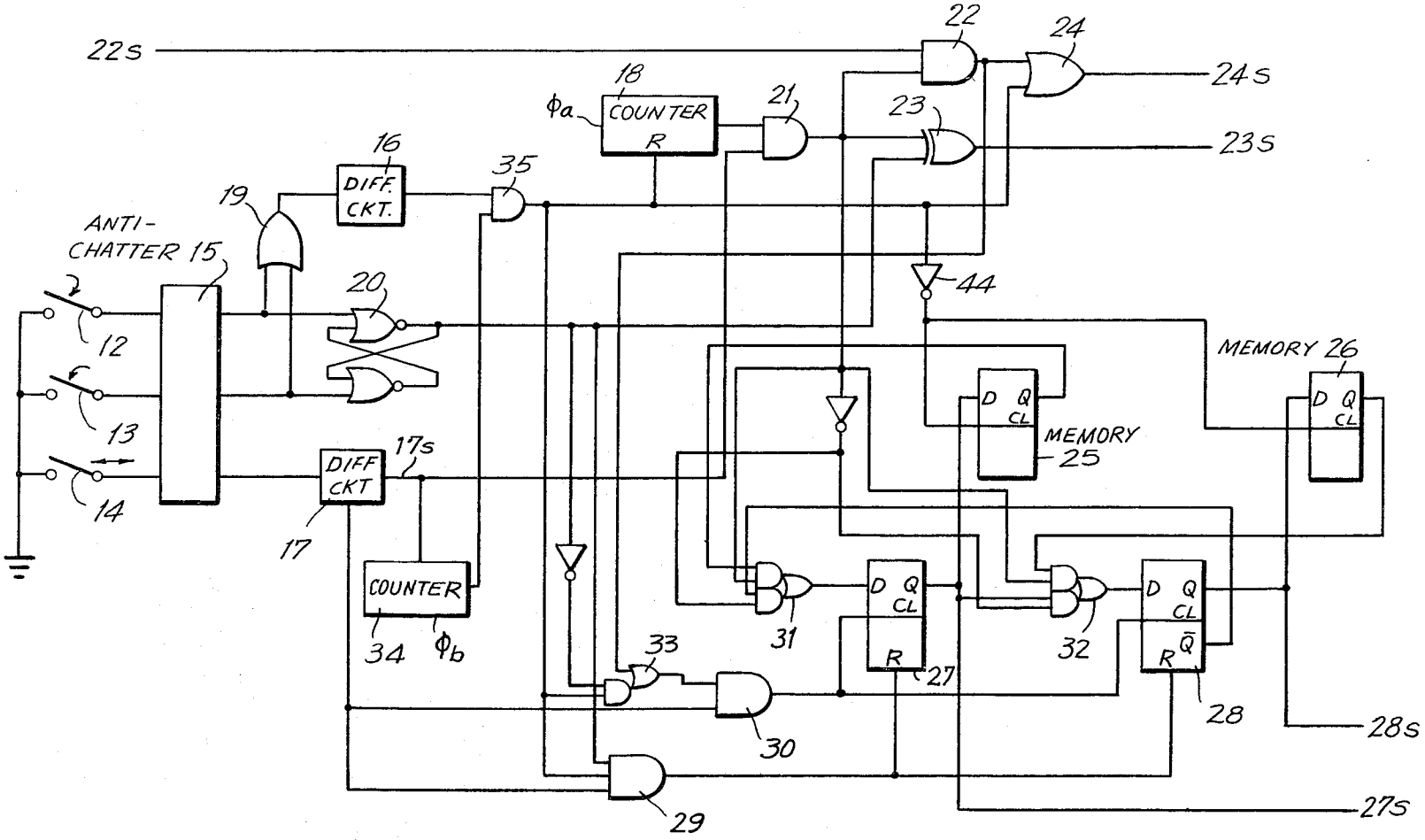
FIG. 3 is a circuit in accordance with this invention for compensating for inadvertent imputs through an external switch member in accordance with FIGS. 1*a, b.

FIG. 3 shows an embodiment in accordance with this invention of circuits which compensate for inadvertent actuations of the switches controlled by the external member. Switches 12, 13 and 14 correspond to switches closed by contacts 6, 7 and 8 in FIG. 1 respectively. That is, switch 12 is actuated when the stem rotates in a clockwise direction; switch 13 is actuated when the stem 1 rotates in a counter-clockwise direction; and switch 14 is actuated when the stem is pulled or pushed. Anti-chatter circuits 15 prevent the results of chattering contacts from being inputted to the circuits and produces a clean signal upon the operation of each switch. When either the switch 12 or 13 is actuated, a differentiation circuit 16 produces a differential signal output pulse. When the switch 14 is turned on or off, the differentiation circuit 17 produces a differential signal.

Because the invention here is concerned with compensation for erroneous inputs to the circuits, the normal operation of the circuits is not explained in detail herein. A description of the conventional components of an electronic timepiece such as the oscillator, divider, timekeeping circuits, display drivers, etc., also is not presented in detail herein. The conventional divider circuit (not shown) provides periodic time signals used in the circuits in accordance with this invention as explained more fully hereinafter. Nevertheless, with regard to normal operation, it should be noted that when switch 13 is closed, that is, upon counter-clockwise revolution of the stem while the stem has not been pulled, i.e., switch 14 is open, it results in a signal passing through an OR gate 19 and differential circuit 16. The output signal from the differential circuit 16 passes through AND gate 35 enabled by a positive output of a counter 34, and then through an AND gate 29 enabled by an output of the differential circuit 17. The output of the AND gate 29 resets a mode counter 27 and a second mode counter 28. The outputs 27*s* and 28*s* from the mode counters 27, 28, respectively, provide a binary code which is used to select the mode of operation of the timepiece display. As described above, a counter-clockwise rotation of the stem reverts the timepiece to the timekeeping mode. This is accomplished by resetting the mode counters 27, 28, as described, so that the code for the timekeeping mode is in binary format 00. There are four combinations possible at the output of the mode counters 27, 28 which readily accommodates the four functional modes of the timepiece described above. In normal operation rotation in a clockwise direction, that is, closing switch 12, provides a pulse from the anti-chatter circuits 15 which passes through the gates 35, 33, 30 to provide clocking signals to the mode counters 27, 28 such that on each pulse the binary code outputs 27*s,* 28*s* change by one digit. Thus, the binary code data at terminals 27*s,* 28*s* provides the outputs to change the displayed modes as described above.

A more detailed description of the operation of the circuit is now presented with reference to a condition where inadvertent operations of the stem have occurred. In the first example of circuit operation, it is intended to pull out the stem, that is, close switch 14, and then rotate the stem in a clockwise direction so as to close switch 12. However, when the stem 1 is pulled out there is unintentional rotation in a clockwise direction and the switch 12 is turned on first and then the switch 14 is turned on. In normal operation closing switch 12 without having first closed the switch 14 would cause the functional mode to change, for example, from the calendar mode to the alarm mode. Here, the user has intended not to change the displayed mode, but merely to correct the displayed mode. How the circuits compensate for this error is now explained. After the switch 12 has closed, but before the switch 14 has closed, an OR gate 19 has a logic 1 applied to its input from the switch 12, the signal having passed through the anti-chatter circuit 15. Because of the resilient characteristics of the switch structure as explained above, the signal from the switch 12 is delivered to the OR gate 19 in the form of a pulse. As a result, a differential signal is delivered from a differentiation circuit 16 which receives the output of the OR gate 19. A positive signal from the anti-chatter circuit 15 resulting from the closure of the switch 12 causes an RS flip-flop circuit 20 to have a logic 0 at its output. This low signal from the flip-flop 20 indicates that a signal from the switch 12 has been applied.

Because the switch 14 is not yet turned on at this time, the differential signal from the circuit 16 due to actuation of the switch 12 passes through an enabled AND gate 35 and is applied as an input to the AND-OR gate 33. The output of the gates 33 feeds through an enabled AND gate 30 and this output signal from gate 30 is applied to two-bit mode counters 27, 28 as clock signal for each counter. As stated above in the description of normal operation, the outputs **27*s* and 28*s* from the mode counters 27, 28 act as a code which determines which mode of operation will be indicated in the timekeeping display. Therefore, as a result of closing switch 12**, the mode which has been indicated is changed to the next mode in the normal sequence.

Also, the differential signal from the circuit 16 due to the operation of the switch 12 is applied to two memory circuits 25, 26 associated with the mode counters 27, 28 respectively. This differential signal is applied to the memory circuits 25, 26 simultaneously as a clock signal. The clock signals for the memory circuits 25, 26 are inverted versions of the clock signals for the mode counters 27, 28 as a result of an inverter 44. The outputs from the mode counters 27, 28, which determine the former mode, that is, the mode before the switch 12 is turned on, are respectively written into the memory circuits 25, 26 for the mode counters.

The differential signal from the circuit 16 passing through the AND gate 35 also causes a counter circuit 18 to reset and start counting. The counter 18 outputs a logic 1 (high) when it is reset and after a predetermined time period, for example, 125 to 250 msec has passed, the counter circuit 18 outputs a logic 0 (low). The counter 18 receives and counts clock signals $\phi_a$ from the divider (not shown) of the timepiece. When the switch 14 is turned on, that is, pulled out, within the predetermined time period after the switch 12 was turned on, a differential signal due to the switch 14 is outputted from the differentiation circuit 17 after passing through the anti-chatter circuit 15. The signal from the differentiation circuit 17 passes through an AND gate 21. The output of the AND gate 21 controls the select gates 31, 32 so that the memories 25, 26 provide input data from their Q terminals to the inputs D of the mode counters 27, 28.

Figure 4:
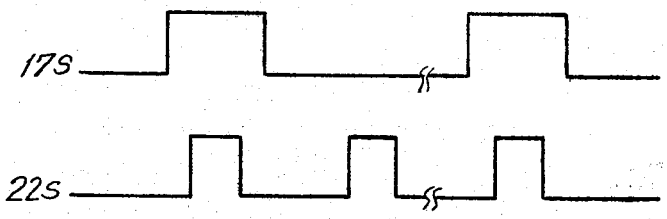
* and FIG. 4 is a timing chart associated with the circuit of FIG. 3.

A signal applied to one input of an AND gate 22 is a timing periodical signal as shown by the waveform **22*s* (FIG. 4). The timing of the signal 22*s* with respect to the differential output signal 17*s* from the differential circuit 17 due to the switch 14 is also as shown in FIG. 4. The AND gate 22 delivers a signal of one pulse for an operation of the switch 14 and the single pulse passes through an AND-OR gate 33. Since at the moment, the AND gate 30 has a logic 1 on one input from the differential circuit 17, the signal from the gate 22 is applied as a write-in clock signal to both of the mode counters 27, 28. In that way, the data stored at the Q terminals of the memory circuits 25, 26 for the mode counters 27, 28 are respectively written back into the mode counters 27, 28 when switch 14 has been actuated during the preselected time period while the counter 18 has a high output. Thus, if the switch 12 or 13 is turned on by accident and the stem 1 is being pulled out, that is, within the preselected time period of counter 18**, the mode is electronically restored to the formerly displayed mode by reapplying to the mode counters the identical data which was stored in memory before the mode is changed.

In the case where the stem 1 is pulled out, that is, switch 14 is actuated, after the preselected time period of counter 18 has passed, because this is defined as a normal operation, the counter circuit 18 has a logic 0 at its output which inhibits the signal from the gate 21 so that the mode counters 27, 28 do not receive clock signals when switch 14 is actuated and therefore the former mode is not restored. It should be understood, that the circuits also operate in the same manner when the stem 1 is pulled out over a rotation in the counter-clockwise direction which actuates the switch 13 prior to actuation of switch 14.

Compensation for the case where the stem 1 is pushed in during an inadvertent rotation is as follows. When the stem 1 is pushed in to close switch 14 along with a rotation in the counter-clockwise direction such that the switch 13 is turned on before switch 14 is actuated, a differential pulse is delivered from the differentiation circuit 16. Also as described above, the counter circuit 18 is reset to have logic 1 at its output. At this time the set-reset flip-flop 20 has a logic 1 at its output also indicating that the switch 13 has been turned on. In normal operation, with switch 14 closed, rotation in the counter-clockwise direction which closes switch 13 causes one pulse to occur at the output terminal **24*s* for correcting purposes and also has the output 23*s* high. This is a code indicating that the pulse at the terminal 24*s*** is to be applied to the timekeeping or calendar circuits as a retarding pulse.

When the stem 1 then is pushed in, that is, closes the switch 14, within the predetermined time period of the counter 18, a differential pulse is delivered from the differentiation circuit 17 which passes through the AND gate 21 and is applied to an input of an exclusive OR gate 23. The combination of a high output from the set reset circuit 20 and the high differential signal from the differentiating circuit 17 applied simultaneously to the exclusive OR gate 23 changes the output signal at **23*s* from a high condition to a low condition. Therefore, the pulse from the switch 14, which is passed through gates 21, 22 and 24, is applied as a correcting pulse in an advancing mode. This is just the opposite of the retard mode which normally accompanies actuation of switch 13**. Thus, an inadvertent retardation is compensated for by the circuits with an advancement in an equal amount of one pulse.

When in a similar situation, the switch 12 is inadvertently actuated by a clockwise motion, the output signal from the set-reset flip-flop 20 is at a logic 0, the opposite of the situation described immediately above. As a result, the exclusive OR gate 23 outputs a low signal at terminal 23*s* when the switch 14 is actuated within the time period of the counter 18. In this way, an unintended advancement is compensated for by an equal retardation. The compensating pulse is delivered through OR gate 24 by way of the AND gate 22.

In summary, when the indication is advanced or retarded by rotating the stem 1 to the right or the left through inadvertance, a compensation for false inputs is made by putting the indication back or ahead respectively in an equal amount. The output 23*s* is used as a signal for selected advancement or retardation, and the output 24*s* supplies the actual correcting signal pulse for each counter when that counter is being corrected. The counters may include in a conventional electronic timepiece a second, minute, and hour counter for the timekeeping mode of operation, and month and day counters for a calendar mode of operation, as well as an alarm setting counter and a timer counter.

When the stem 1 is pushed in after the preselected time period of counter 18 has passed, no compensating signal is delivered because the counter circuit 18 has a logic 0 at its output which blocks the AND gate 21.

The above description applies to situations where the stem 1 is rotated before it is pushed in. The situation where the stem 1 is rotated after it has been pushed in is described as follows.

A counter associated with the differentiation circuit 17 is similar to the counter 18. The counter circuit 34 is reset by the differential signals delivered from the differential circuit 17 when the stem 1 is pushed in, that is, switch 14 is actuated. When reset, the counter circuit 34 has logic 0 at its output and this logic is applied to the AND gate 35. After a predetermined period, for example, 250 to 500 msec, the counter circuit 34 has a logic 1 at its output. Thus, rotation of the stem 1, during the predetermined time period established by the counter 34, after the stem is pushed in does not result in any imputs to the system.

As stated above, in accordance with this invention, disadvantages caused by inadvertent and erroneous operation of the stem or an external control member are reduced. Further, an improvement is realized by using circuits, as described, which are easy to fabricate. Using the compensating circuits gives an advantage to the use of a stem as an external member for an electronic timepiece.

It should be understood that the compensating circuits of this invention are suited not only to a combination of switches in a stem structure as described above but also to any combination of switches requiring a selected operational sequence.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic timepiece including a plurality of functional modes for display, comprising:

circuit means for varying the functional mode for display;

switch means, said switch means being adapted for actuation in a plurality of modes in sequence, selected modes of switch actuation in a selected sequence initiating at least one selected variation in a display, said switch means inputting signals to said circuit means for varying the functional mode;

compensating circuits, said compensating circuits being adapted to discriminate between the occurrence of said switch modes of actuation in said selected sequence or in a non-selected sequence, said compensating circuits outputting control signals to said circuit means for varying the functional mode for display, variations in said display resulting from at least one actuation in said non-selected sequence being negated by a subsequent actuation in said non-selected sequence, said display being restored to the state existing prior to said non-selected sequence.

2. An electronic timepiece as claimed in claim 1 wherein said compensating circuits include at least one timer function, said compensating circuits discriminating between switch actuations occurring within and without a prescribed time period as measured by said timer function, whereby said actuation sequence is discriminated to be either selected or non-selected.

3. An electronic timepiece as claimed in claim 2, wherein said compensating circuits further comprise at least one memory function, said memory function on an actuation of said switch function storing instantaneous data outputs of said circuit means for varying the functional mode for display, said data outputs being varied by said actuation of said switch function after said instantaneous data is stored, said at least one memory function being adapted to return said stored instantaneous data to the outputs of said circuit means for varying the functional mode for display, said return being initiated when said timer function discrminates a non-selected sequence, whereby the effect of said non-selected sequence is compensated by restoration of said instantaneous data outputs to said circuit means for varying the functional mode of display.

4. An electronic timepiece as claimed in claim 3 wherein said circuit means for varying the functional mode for display include a set-reset circuit, the output of said set-reset circuit being high or low in response respectively to each of two modes of actuation of said switch means, said high producing an opposite variation on said display than said low.

5. An electronic timepiece as claimed in claim 4 wherein said compensating circuits are adapted to reverse the output of said set-reset circuit on the occurrence of a non-selected sequence, whereby the variation caused by a switch means actuation reverses the variation caused by the preceding switch means actuation of a non-selected sequence.

6. An electronic timepiece as claimed in claim 1 or 5 wherein said switch means is an external member, and said actuation modes include pull, push, clockwise rotation, and counterclockwise rotation, switch contacts being associated for actuation in each said actuating mode.

7. An electronic timepiece as claimed in claim 6 wherein said clockwise rotation changes the display of functional mode, said data outputs of said circuit means for varying the functional mode for display changing in response to said clockwise rotation and determining the displayed functional mode.

8. An electronic timepiece as claimed in claim 7 wherein said counterclockwise rotation returns said display to a preferred functional mode.

9. An electronic timepiece as claimed in claim 8 wherein pulling said external member enables said circuit means for varying the functional mode for display for correction of the displayed functional mode.

10. An electronic timepiece as claimed in claim 9 wherein, after enablement, rotation of said external member causes said correction of said displayed functional mode.

11. An electronic timepiece comprising a first switch means, said first switch means being opened or closed by rotating an external control member; a second switch means, said second switch means being opened or closed by pushing or pulling said external control member; operation of said switch means introducing input signals, said input signals altering instantaneous data conditions in circuits of said timepiece; counter circuits for counting the time elapsed from the operation of said first switch means to the operation of said second switch means and the time elapsed from the operation of the second switch means to the operation of said first switch means; and compensating circuits for compensating for said input signals from said switch means, said counter circuits outputting signals to said compensating circuits for compensation when said time elapsed is less then a predetermined value, said compensation circuits negating the output signals from said switch means by restoring said circuits of said timepiece to said instantaneous data conditions.

* * * * *